US007100371B2

(12) United States Patent
Bitter et al.

(10) Patent No.: US 7,100,371 B2
(45) Date of Patent: Sep. 5, 2006

(54) HYDRAULIC ARRANGEMENT AND PROCESS FOR ITS USE

(75) Inventors: Marcus Bitter, Contwig (DE); Heinz Peter Huth, Überherrn (DE); Michael Kühn, Wotenitz (DE); Reiner Hoffmann, Illingen (DE)

(73) Assignee: Deere & Company, Moline, IL (US)

( * ) Notice: Subject to any disclaimer, the term of this patent is extended or adjusted under 35 U.S.C. 154(b) by 67 days.

(21) Appl. No.: 10/943,043

(22) Filed: Sep. 16, 2004

(65) Prior Publication Data

US 2005/0072144 A1 Apr. 7, 2005

(30) Foreign Application Priority Data

Oct. 2, 2003 (DE) ..... 103 45 956

(51) Int. Cl.
*F16D 31/02* (2006.01)

(52) U.S. Cl. ..... 60/418; 60/403

(58) Field of Classification Search ..... 60/327, 60/403, 413, 418, 469
See application file for complete search history.

(56) References Cited

U.S. PATENT DOCUMENTS

| | | | | |
|---|---|---|---|---|
| 3,557,955 | A * | 1/1971 | Hirs et al. | 210/793 |
| 3,922,854 | A | 12/1975 | Coeurderoy | |
| 4,476,677 | A * | 10/1984 | Hanshaw | 60/413 |
| 5,301,505 | A * | 4/1994 | Wright | 60/413 |
| 5,355,676 | A * | 10/1994 | Inokuchi | 60/413 |
| 5,513,491 | A | 5/1996 | Broenner et al. | |
| 5,687,567 | A * | 11/1997 | Hansson et al. | 60/413 |
| 5,865,028 | A * | 2/1999 | Klauk et al. | 60/413 |
| 6,357,230 | B1 * | 3/2002 | A'Hearn et al. | 60/413 |

FOREIGN PATENT DOCUMENTS

| | | |
|---|---|---|
| DE | 34 47 380 | 12/1984 |
| DE | 42 21 943 | 7/1992 |
| DE | 43 08 460 | 3/1993 |
| DE | 694 20 282 | 10/1994 |
| DE | 197 51 274 | 11/1997 |
| DE | 201 14 538 | 9/2001 |
| DE | 102 15 558 | 4/2002 |
| WO | WO 03/068653 | 2/2003 |

OTHER PUBLICATIONS

Patent Abstracts of Japan JP58121305, Jul. 19, 1983.

* cited by examiner

*Primary Examiner*—Edward K. Look
*Assistant Examiner*—Michael Leslie

(57) ABSTRACT

A hydraulic arrangement is provided with at least one pressure accumulator for a hydraulic fluid, a hydraulic cylinder with at least one chamber to which pressure can be applied, a connecting line, on the basis of which the at least one accumulator is connected with the chamber, and a control unit. In order to provide an electronic pipe break safety device, an electronically controlled on-off valve is mounted in the connecting line and coupled for receiving control signals from the control unit, and a signal transmitter, which is coupled for monitoring the pressure in the connecting line is also connected to the control unit. If a pressure drop occurs in the connecting line, a signal change is generated by means of the signal transmitter, whereupon the control unit sends a signal effecting movement of the shut-off valve to its closed position.

4 Claims, 2 Drawing Sheets

HYDRAULIC ARRANGEMENT AND PROCESS FOR ITS USE

FIELD OF THE INVENTION

The invention concerns a hydraulic arrangement and a process for a hydraulic arrangement, with at least one pressure accumulator for a hydraulic fluid, at least one hydraulic cylinder with a chamber that can be supplied with pressure, a connecting line on the basis of which the at least one pressure accumulator can be connected with the at least one chamber, and a control unit.

BACKGROUND OF THE INVENTION

Hydraulic arrangements are known in which mechanical pipe break safety valves are applied with which hydraulic cylinders are secured against unintended retraction or extension, in case that one of the connecting lines should break.

The operating principle of these pipe break safety devices consists of the fact that upon a drop in pressure across the valve, a valve slide is forced against a valve seat by a certain spring force so as to seal against any leakage, and thereby a further flow of oil is prevented.

In most hydraulic arrangements, the securing of a chamber of a hydraulic cylinder loaded by pressure is provided in the form of a load holding valve in hydraulic supply lines. However, if additional components are applied, for example, pressure accumulators, that can be used, for example, in hydro-pneumatic spring support systems or load holding systems, it is useful to also provide a pipe break safety valve arrangement in the connecting lines of the chamber of the hydraulic cylinder that is supplied with pressure, since in case of a break of the connecting lines, the hydraulic cylinder could drop abruptly.

U.S. Pat. No. 5,513,491 discloses a hydraulic arrangement for a lifting arrangement of an operating machine in which several hydraulic cylinders, arranged in parallel, can be connected over connecting lines and shut-off valves with several hydro-pneumatic pressure accumulators. Thereby a hydro-pneumatic spring suspension is to be created with which the lifting arrangement can be spring supported and vibrations of the operating machine can be reduced. The disadvantage here is that the connecting lines are not provided with any pipe break safety arrangements so that in the case of a pipe break in any of the connecting lines, the hydraulic cylinder or cylinders could drop abruptly.

A pipe break safety arrangement is applied, for example, in the patent application disclosed by the Japanese patent office in the patent abstract JP 58121305 AA for a pressure holding system of a hydraulic cylinder. This hydraulic circuit arrangement shows a hydraulic cylinder that is connected over a connecting line with a pressure accumulator. When pressures in the chambers of the cylinder change, the pressure accumulator is intended to compensate so that the pressure in the chambers is maintained. In order to provide assurance that the hydraulic cylinder does not drop upon a pipe break or leakage in the supply line to the pressure accumulator, a mechanical pipe break safety arrangement is arranged in the connecting line in the form of a two-pressure valve. Here the disadvantage develops that such mechanical pipe break safety arrangements tend to close when high volume flows are encountered between hydraulic cylinders and pressure accumulators in hydro-pneumatic spring support systems, without the pressure drop associated with an actual pipe break therefore, such a mechanical pipe break safety arrangement is not appropriate as a protection against a pipe break in pressure accumulator lines for a hydro-pneumatic spring support system.

The task underlying the invention is seen in the need to define a hydraulic arrangement of the type defined initially by means of which the aforementioned problems are overcome.

SUMMARY OF THE INVENTION

The present invention relates to hydraulic arrangement including a hydraulic cylinder and accumulator coupled to each other and further including pipe break protection.

An object of the invention is to provide a hydraulic arrangement, of the class noted above, wherein the pipe break protection includes a shut-off valve actuated by a control unit which receives a signal dependent upon pressure generated by a pressure switch or pressure sensor connected for responding to a pressure drop occurring in a connecting line joining an accumulator with one chamber of a hydraulic cylinder.

According to the invention, in a hydraulic arrangement of the aforementioned type, at least one shut-off valve that can be actuated by the control unit and a signal transmitter operating as a function of pressure, particularly a pressure switch or a pressure sensor, are arranged in the connecting line, where a pressure drop in the connecting line can be transmitted as a signal to the control unit by means of the signal transmitter. A pressure drop can occur, for example, when the connecting line breaks, this could be configured as a hose or a tube. In case of such an occurrence, the pressure in the connecting line falls to the ambient pressure within fractions of a second. Thereupon, the signal transmitter generates a change in the signal, preferably an electrical signal, that is transmitted to a control unit, preferably an electronic control unit. The control unit registers the corresponding change in the signal and generates a closing signal for the shut-off valve, that is thereupon closed, so that no more hydraulic fluid can escape from the pressurized chamber of the hydraulic fluid cylinder, or that the piston of the hydraulic cylinder remains in its position. Thereby the hydraulic arrangement, according to the invention, contains an electrically controlled pipe break safety device. Preferably the stop valve is attached in the immediate vicinity of the hydraulic cylinder, so that the largest possible area of the connecting line is secured.

Preferably, the shut-off valve can be controlled electrically by the electronic control unit. It is also conceivable that the shut-off valve is a hydraulically or pneumatically controlled valve that can be controlled by a corresponding hydraulic or pneumatic control unit.

For the signal transmitter, a pressure switch can be applied that is deactivated by the pressure drop when a predetermined minimum pressure falls short, and thereby brings about a change in the signal. The application of a pressure sensor is also conceivable, that transmits a continuous tension signal that changes in proportion to the pressure existing in the connecting line. When a predetermined minimum pressure falls short, the electrical control unit generates a closing signal.

Another preferred possibility is represented by a volume flow sensor that transmits a signal for a change in the volume flow which is a function of the pressure. Here the closing signal is generated by the volume flow that falls short of a predetermined minimum value.

The advantages of this invention lie in the fact that hydraulic cylinders that must be secured against sudden pressure drop in the chamber supplied with pressure or a pressure drop resulting from an operating disturbance or a break in a line, that results in a drop of the piston of a hydraulic cylinder, that can be connected with other hydraulic implements, for example, hydro-pneumatic pressure accumulators over connecting lines, such as hose lines, tube lines or the like, without having to apply mechanical pipe break safety devices. This advantage becomes particularly clear when high volume flows are encountered that could occur with a hydro-pneumatic spring support system, since mechanical pipe break safety devices tend to close suddenly at high values of volume flow. By the application of a hydraulic arrangement, according to the invention, with an electronic pipe break safety arrangement, an unintended closing of the connecting line can be avoided. This offers the possibility of, for example, locating a hydro-pneumatic pressure accumulator as far as desired from the hydraulic cylinder, so that space problems of compact hydraulic installations can be solved.

A further advantage of the invention lies in the fact that it is possible to close the connecting line at any time desired by a corresponding control of the existing shut-off valve of the electric pipe break safety device. In a corresponding hydraulic arrangement with a mechanical pipe break safety device, a separate shut-off valve would be required that would bring about additional costs. For applications with high volume flows, mechanical pipe break safety devices must be configured with correspondingly large dimensions, that would clearly demand additional costs, compared to an electronic pipe break safety device.

As a result of the possibility of closing the connecting line at any time desired, there is another possibility that is significant to the safety of the arrangement. For example, the hydraulic arrangement can be enlarged by a temperature detection device, whereby the electronic control unit can be supplied with a limiting temperature value signal, on the basis of which the connecting line is closed. This may be useful, for example, if the viscosity of the hydraulic fluid increases at extremely low operating temperatures in such a way that a reliable detection of a sudden pressure drop by the signal transmitter is no longer possible.

According to the invention, a second shut-off valve may be provided in the connecting line, that is preferably attached in the immediate vicinity of the hydro-pneumatic pressure accumulator and that can also be brought into the closing position by the electronic control unit, as soon as the pressure switch brings about a change in the signal. This can prevent, for example, upon a pipe break in the connecting line, that the entire pressure accumulator is drained or that it loses its loading pressure. In the case of correspondingly long connecting lines, several shut-off valves may be arranged in different sections which would minimize the loss of hydraulic fluid in case of a pipe break, since in a pipe break only the fluid in the damaged section would drain away.

In a particularly preferred embodiment of the invention, a first supply line is provided on the basis of which a connection can be established between the at lest one chamber and the hydraulic pump or a hydraulic tank. Thereby the hydraulic cylinder can be filled selectively and thereby recoil elastically about a rest position in connection with a hydro-pneumatic pressure accumulator, as soon as the supply line is closed and the connecting line is opened. A hydro-pneumatic spring support arrangement attained in this way is therefore preferably activated by an activation switch for the electronic control unit. When the spring support system is activated, the shut-off valve can be opened by means of the electronic control unit. Here the control unit is configured in such a way that the shut-off valve is opened only if a predetermined minimum pressure exists in the connecting line and the signal transmitter transmits a corresponding signal. In case that the minimum pressure does not exist in the line to the pressure accumulator, then no opening signal exists either. The same applies when the signal transmitter is defective or a fault exists in the electric supply, for example, in the wiring harness of the electronic supply. Only if a pre-established or predetermined opening signal exists, the control unit generates a signal for the opening of the shut-off valve in the connecting line.

In a further preferred embodiment of the invention, the hydraulic cylinder contains a second chamber to which pressure can be applied, which can be connected to the hydraulic pump or the hydraulic tank over a second supply line. This makes it possible for the hydraulic cylinder to be moved actively in both directions, that is, that an accelerated lowering of the piston of the hydraulic cylinder can be attained. For this purpose the second chamber of the hydraulic cylinder is connected with the hydraulic pump and simultaneously the first chamber is connected with the hydraulic tank. Without any pressure being applied to the second chamber, the hydraulic piston would be extended only due to the forces applied to it. Pressure applied to the second chamber, that is, an active lowering of the hydraulic piston is desirable if short lifting and lowering cycles are to be attained, for example, during loader operations.

In a preferred embodiment of the invention, a selector valve is provided that contains at least three positions which can be controlled and with which the supply lines can selectively be connected correspondingly with the hydraulic pump or with the hydraulic tank or these connections blocked. In a first position, a lifting position, the first supply line is connected with the hydraulic pump and simultaneously the second supply line is connected with the hydraulic tank. In the lifting position, hydraulic fluid can be pumped into the first chamber and excess hydraulic fluid can be drained from the second chamber into the hydraulic tank. In a second position, the lowering position, the first supply line is connected with the hydraulic tank and simultaneously the second supply line is connected with the hydraulic pump. In the lowering position hydraulic fluid can be pumped into the second chamber and the excess hydraulic fluid can be drained from the first chamber into the hydraulic tank. Thereby, the hydraulic piston can be lowered actively, that is, under pressure of the hydraulic pump, resulting in the attainment of faster lowering velocities. Preferably, the spring support action can be deactivated in the lifting position as well as the lowering position or the shut-off valve in the connecting line can be closed, so that no hydraulic fluid reaches the pressure accumulator. On the other hand, it may also be useful to open the shut-off valve in order to fill the pressure accumulator thereby or in order to increase the spring pressure. In a third position, the semi-closed position, that also represents a preferred spring position, the first supply line is closed and the second supply line is connected with the hydraulic tank. In this position, with active spring movement and the shut-off valve opened, the hydraulic piston can perform a spring movement in which, for example, if shocks occur, the hydraulic piston is forced downward and the hydraulic fluid remaining in the first chamber is forced in the direction of the pressure accumulator. The compression effect in the pressure accumulator generates a spring movement whereby the hydraulic piston is again moved in the opposite direction. Thereupon excess hydraulic fluid from the second chamber can drain into the hydraulic tank over the control valve.

In a further preferred embodiment of the invention, a selector valve is provided that contains a fourth position, a fully closed closing position, in which the first supply line as well as the second supply line are closed. A fully closed closing position may be useful if, for example, a hydro-pneumatic spring support is to be omitted, so that the hydraulic piston can remain in its position independent of any external effects and does not perform any spring movement.

In a further preferred embodiment of the invention, a loader line is provided on the basis of which a connection can be established between the at least one chamber and the pressure accumulator. On the basis of the loader line, the pressure accumulator can be held within a pressure level or brought to that pressure level, which corresponds at least to the pressure level in the first chamber. This provides the assurance that the pressure accumulator is sufficiently preloaded at all times, in order to generate a sufficiently high spring effect.

In a further preferred embodiment of the invention, the loader line contains a check valve opening in the direction of the pressure accumulator. This provides the assurance that hydraulic fluid can at all times flow only in the direction of the pressure accumulator over the loader line. Thereby, if the spring support function is deactivated or if the shut-off valve is closed in the connecting line, no hydraulic fluid can flow out of the pressure accumulator in the direction of the first chamber.

In a further preferred embodiment of the invention, the loader line is provided with a pipe break safety valve. Here a shut-off valve can again be used that is actuated by the control unit in connection with a pressure accumulator. However, a conventional mechanical pipe break safety valve is particularly appropriate here, for example, a two-pressure valve. Thereby, the loader line is secured against a pipe break and closed, as soon as a pressure drop occurs in the loader line or even in the connecting line. Here a mechanical pipe break safety device is adequate, since an unintentional closing of the loader line brought about by high volume flows would not have any significant effect upon the spring action. A pipe break safety device is recommended here, since in case of a break in the loader line, the shut-off valve of the connecting line would close, but hydraulic fluid could continue to escape from the first chamber.

According to the invention, a process is described for a hydraulic arrangement, that is configured according to one of the embodiments described above. Here a shut-off valve and a signal transmitter, operating as a function of pressure, is included in the connecting line between the first chamber and the pressure accumulator. According to the invention, the process provides that the signal transmitter generates a signal change upon a pressure drop in the connecting line, the signal change may be, for example, by transmitting a signal only when a minimum pressure exists in the connecting line and the signal disappears upon a pressure drop or the signal drops to zero. This signal change is registered by an electronic control unit, whereupon it generates a closing signal for the shut-off valve and the connecting line is closed. Thereby the process according to the aforementioned advantages as opposed to conventional mechanical pipe break safety devices, particularly in applications to hydro-pneumatic pressure accumulators for the spring support of a hydraulic cylinder.

BRIEF DESCRIPTION OF THE DRAWINGS

The drawing shows two embodiments of the invention on the basis of which the invention as well as further advantages and advantageous further developments and embodiments of the invention shall be explained and described in greater detail in the following.

DESCRIPTION OF THE PREFERRED EMBODIMENT

Figure 1:
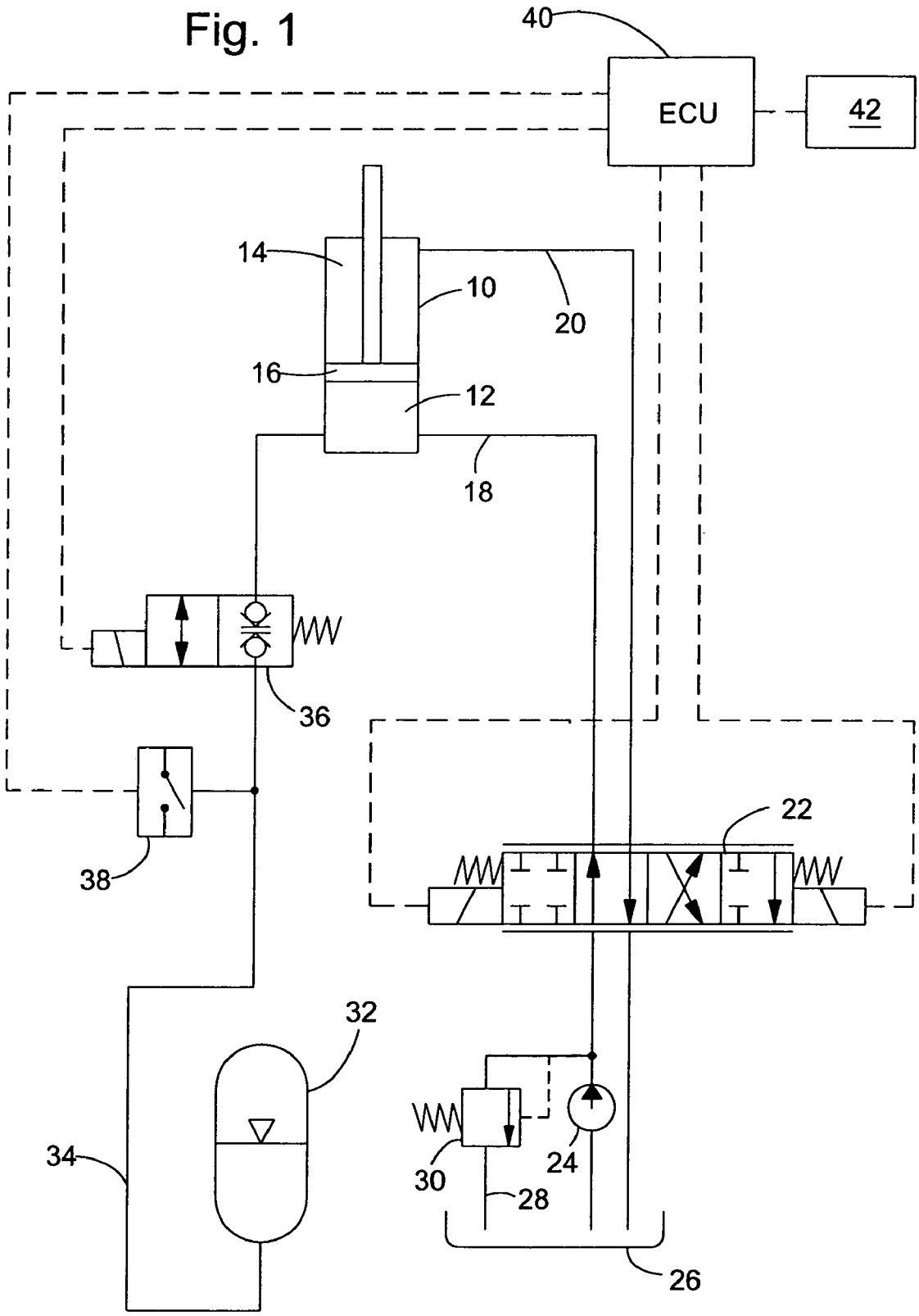
FIG. 1 is a hydraulic circuit diagram of a first embodiment of a hydraulic arrangement according to the invention.

FIG. 1 shows a hydraulic arrangement including a hydraulic cylinder 10 having a first chamber 12 and a second chamber 14. A hydraulic piston 16 is arranged between the chambers 12 and 14.

The first chamber 12 is connected over a first supply line 18, and the second chamber 14 is connected over a second supply line 20, to an electrically controlled control valve 22. By means of the control valve 22, the first and the second supply lines 18 and 20 can selectively be connected with a hydraulic pump 24 or a hydraulic tank 26. Furthermore, it is possible to close both supply lines 18 and 20 by means of the control valve 22.

The control valve 22 is a four position valve, and in particular, includes a lifting position, a lowering position, a semi-closed position and a fully closed position. In the lifting position, the first supply line 18 is connected with the hydraulic pump 24, and the second supply line 20 is connected with the hydraulic tank 26. In the lowering position, the first supply line 18 is connected with the hydraulic tank 26 and the second supply line 20 is connected with the hydraulic pump 24. In the semi-closed position, the first supply line 18 is closed and the second supply line 20 is connected to the hydraulic tank 26. In the fully closed position, the first and second supply lines 18 and 20, respectively, are both closed.

In the fully closed position, a flow conveyed by the hydraulic pump 24 is deflected over an equalizing line 28 and a pressure controlled opening valve 30 into the hydraulic tank 26.

Moreover, a hydro-pneumatic pressure accumulator 32 is provided that is connected with the first chamber 12 of the hydraulic cylinder 10 over a connecting line 34. The connecting line 34 contains an electrically controlled shut-off valve 36 that can be brought into a closed position and a through-flow position. Furthermore, a pressure switch 38 is arranged between the shut-off valve 36 and the pressure accumulator 32.

Moreover, an electronic control unit 40 is included that is connected electrically with the control valve 22 and the shut-off valve 36 as well as the pressure switch 38. Furthermore, an activation switch 42 is provided, with which a control mode is activated for the control of the shut-off valve 36.

The hydraulic circuit arrangement shown in FIG. 1 represents a spring support system, in which a spring action is generated in that the hydro-pneumatic pressure accumulator 32 interacts with the pressurized pressure chamber 12 of the hydraulic cylinder 10. In order to avoid the hydraulic cylinder 10 from dropping suddenly upon a pipe break of the connecting line 34, the pressure switch 38 is provided that transmits a signal change to the electronic control unit 40 upon a pressure drop in the connecting line 34.

In the following, the various methods of operation of the hydraulic arrangement shall be described.

If the control valve 22 is brought into the lifting position, then hydraulic fluid is pumped through the first supply line 18 to the first chamber 12, whereby the hydraulic piston 16 is raised. Simultaneously, excess hydraulic fluid can drain off from the second chamber 14 into the hydraulic tank 26. If the control mode is activated for the control of the shut-off valve 36 by means of the activation switch 42, the shut-off valve 36 is opened as long as a predetermined minimum pressure has been built up in the connecting line 34. In this condition, the spring action is active, since now an interaction can occur between the first chamber 12 and the pressure accumulator 32. If the hydraulic piston is now moved downward, for example, by an impact or by an acceleration of the tractor, this movement can be intercepted by the pressure accumulator 32 or by spring action, since hydraulic fluid can drain off against a pressure force of the pressure accumulator 32 out of the first chamber 12 into the pressure accumulator 32. An increased pressure is now built up in the pressure accumulator 32 by gas compression, that again forces the hydraulic piston 16 in the opposite direction until it has again reached its initial position, if necessary after a few cycles of spring movement.

If the control mode for the shut-off valve 36 is activated during the lifting phase of the hydraulic cylinder 10, then the pressure accumulator 32 is filled or loaded parallel to the lifting of the hydraulic piston 16.

Now, if a pipe break occurs in the connecting line 34, the pressure in the connecting line drops. The pressure switch 38 that was activated before a pipe break and was retained in a closed position on the basis of a minimum pressure in the connecting line 34, is now deactivated or opened, since the minimum pressure no longer exists. This brings about a change in the signal as a result of which the signal at the electronic control unit drops to zero at a minimum pressure, since the pressure switch 38 is opened. As soon as the electronic control unit 40 registers the fact that no signal exists, or that a change in the signal has occurred, it generates a closing signal for the shut-off valve 36, whereupon the connecting line 34 is closed, so that no more hydraulic fluid can escape from the first chamber 12.

If the control valve 22 is brought into the lowering position, then hydraulic fluid is pumped through the second supply line 20 into the second chamber 14, whereby the hydraulic piston 16 is lowered. Simultaneously, excess hydraulic fluid can drain off from the first chamber 12 into the hydraulic tank 26. The control unit 40 may be configured in such a way that the shut-off valve 36 is not opened in a lowering position when the control mode is activated by means of the activation switch 42. This can avoid hydraulic fluid from draining out of the pressure accumulator 32 into the hydraulic tank 26. However, a closing position of the shut-off valve 36 is not absolutely required, since the pressure accumulator can subsequently be charged again in a lifting position.

If the control valve 22 is brought into the semi-closed position, then the first supply line 18 is closed and hydraulic fluid can drain off out of the second chamber 14 into the hydraulic tank 26. The control mode for the control of the shut-off valve 36 can be activated by means of the activation switch 42. As a result of this, the shut-off valve 36 is opened, as long as a predetermined minimum pressure has been built up in the connecting line 34. In this condition, the spring support is active, since now an interaction can take place between the first chamber 12 and the pressure accumulator 32. If the hydraulic piston 16 is moved downward, for example, by an impact or by accelerating forces, this movement can be intercepted or converted into spring action by the pressure accumulator 32, since hydraulic fluid can flow out of the first chamber 12 into the pressure accumulator 32 against a pressure force of a pressure accumulator 32. An increased pressure is now built up in the pressure accumulator 32 by gas compression in the pressure accumulator 32, which forces the hydraulic piston 16 again in the opposite direction until it has resumed its initial position, if necessary after a few spring-action cycles of movement. If the hydraulic piston 16 is deflected in the other direction or moved upward, hydraulic fluid can drain off into the hydraulic tank 26. Accordingly, the semi-closed position represents the preferred position for spring action, in which the hydraulic piston 16 is to be retained in its predetermined position, which accelerating forces acting on the hydraulic piston 16 from outside can be intercepted by the pressure accumulator 32. Preferably, the control valve 22 is switched into the semi-closed position, after a lifting or lowering process, once the desired position of the hydraulic piston 16 has been reached, as long as a spring support action is desired.

If no spring action is desired, the control valve 22 can also be brought into a fully closed position, in which the first and second supply lines 18 and 20, respectively, are closed. An activation of the control mode for the control of the shut-off valve 36 is also possible in the fully closed position, however, it should be noted here that the hydraulic piston 16 can deflect with spring action only in the direction of the first chamber 12.

If not spring action is desired, the control valve 22 can also be brought into a fully closed position, in which the first and second supply lines 18 and 20, respectively, are closed. An activation of the control mode for the control of the shut-off valve 36 is also possible in the fully closed position, however, it should be noted here that when the hydraulic piston 16 can deflect with spring action only in the direction of the first chamber 12.

Regardless of the position of the control valve 22, an electronic pipe break safety device of the connecting line 34 to the pressure accumulator 32 is provided, where in the lowering position, an activation of the control mode for the shut-off valve 36 is stopped by the electronic control unit 40, and hence the shut-off valve 36 is closed. In the remaining three positions, with active spring support action, the connecting line 36 is reliably secured by the electronic pipe break safety device.

By deactivating the activation switch 42, the control mode for the shut-off valve 36 can be stopped at any time, which leads to the immediate closing of the control valve 36. This may be of interest if, for example, no spring support action is desired.

Figure 2:
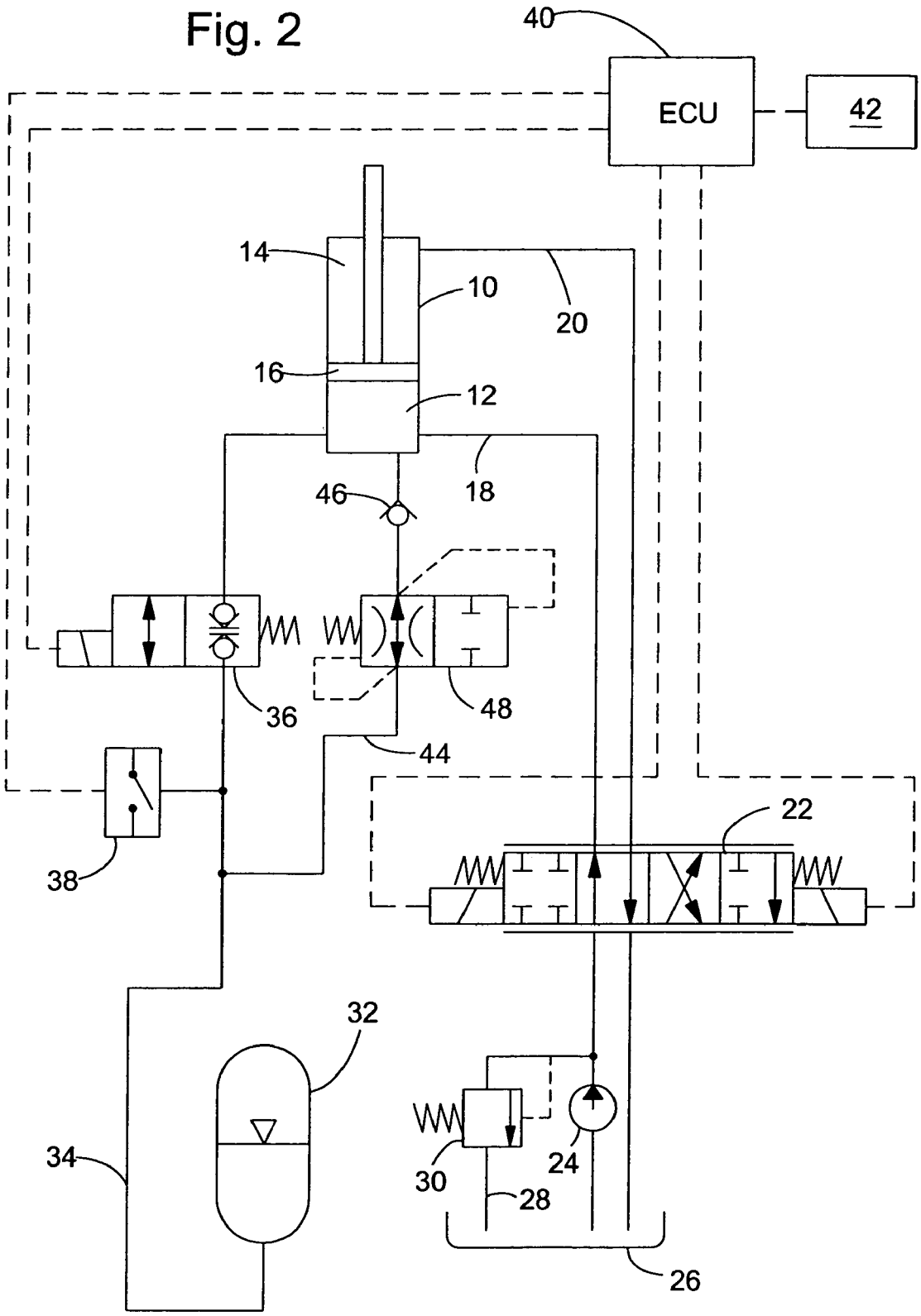
FIG. 2 is a hydraulic circuit diagram of a second embodiment of a hydraulic arrangement according to the invention with a loader line.

FIG. 2 shows an addition to the hydraulic circuit arrangement of FIG. 1. Here, the circuit arrangement of FIG. 1 is supplemented by the addition of a loader line 44. The loader line 44 extends between the first chamber 12 of the hydraulic cylinder 10 and the connecting line 34, where the connecting point lies in the direction of the pressure accumulator 32 behind the pressure switch 38. A check valve 46 is provided in the loader line 44, that permits a flow of hydraulic fluid only in the direction of the pressure accumulator 32. A mechanical pipe break safety valve 48 is provided in the direction of the pressure accumulator behind the check valve 46, it is preferably a two-pressure valve. The loader line 44 makes it possible for the pressure accumulator 32 to be under pressure at all times which is at least as high as that in the first chamber 12 of the hydraulic cylinder 10. Here the check valve 46 provides the assurance that hydraulic fluid can flow out of the first chamber 12 into the pressure accumulator 32 in order to load or charge the latter, but that no hydraulic fluid can flow out of the pressure accumulator 32 into the first chamber 12 over the loader line. Thereby, hydraulic fluid can flow out of the pressure accumulator 32 into the first chamber 12 only at the time that the electrical pipe break safety device is activated or the shut-off valve 36 is open. The mechanical pipe break safety valve 48 is used to secure the loader line 44 in case that a pipe break occurs in the loader line.

Although the invention has been described in terms of only two embodiments, anyone skilled in the art will perceive many varied alternatives, modifications and variations in light of the foregoing description as well as the drawing, all of which fall under the present invention. Thus, it will become apparent that various modifications can be made without departing from the scope of the invention as defined in the accompanying claims.

The invention claimed is:

1. In a hydraulic arrangement including at least one pressure accumulator for hydraulic fluid, at least one hydraulic cylinder having at a first chamber and a second chamber to which pressure can be applied, a connecting line connecting said first chamber to said accumulator, and a control unit, the improvement comprising: a selector valve coupled to said first and second chambers and including a position for blocking fluid flow to and from said first chamber while establishing a drain passage for said second chamber; a normally closed shut-off valve being located in said connecting line and being connected for being actuated by said control unit; a signal transmitter coupled to said connecting line and to said control unit and being responsive to a pre-selected minimum pressure for supplying a signal to said control unit for actuating said shut-off valve to an open position, whereby a pressure drop in said connecting line will result in a loss of said minimum pressure which, in turn, will result in a loss of a signal being transmitted to said control unit by said signal transmitter, and consequently a loss in a control signal from said control unit to said shut-off valve.

2. The hydraulic arrangement, as defined in claim 1, and further including a loader line coupled between said first chamber and said accumulator; and a pipe break valve being located in said loader line and normally establishing a fluid path between said first chamber and said accumulator, but being responsive to a loss of pressure for blocking said path.

3. The hydraulic arrangement, as defined in claim 2, wherein said loader line contains a check valve located between said first chamber and said pipe break valve for preventing flow in the direction of said first chamber.

4. A process for preventing an abrupt movement of a hydraulic piston of a hydraulic cylinder normally supported by fluid pressure contained in a hydraulic accumulator coupled to a chamber of said hydraulic cylinder by a connecting line, comprising the steps of:

a. providing an on-off valve in said connecting line, which is responsive to a first signal so as to establish an open fluid path between said accumulator and chamber when a predetermined minimum pressure is present in said connecting line;

b. monitoring the pressure in said connecting line; and c. sending a second signal to said on-off valve for causing the latter to move to its closed position when the pressure in said connecting line falls below said predetermined minimum pressure.

* * * * *